US007854828B2

(12) United States Patent
Reid et al.

(10) Patent No.: US 7,854,828 B2
(45) Date of Patent: Dec. 21, 2010

(54) METHOD AND APPARATUS FOR ELECTROPLATING INCLUDING REMOTELY POSITIONED SECOND CATHODE

(75) Inventors: Jonathan Reid, Sherwood, OR (US); Seshasayee Varadarajan, Lake Oswego, OR (US); Bryan Buckalew, Tualatin, OR (US); Patrick Breiling, Portland, OR (US); Glenn Ibarreta, Tualatin, WA (US)

(73) Assignee: Novellus Systems, Inc., San Jose, CA (US)

( * ) Notice: Subject to any disclaimer, the term of this patent is extended or adjusted under 35 U.S.C. 154(b) by 1141 days.

(21) Appl. No.: 11/506,054

(22) Filed: Aug. 16, 2006

(65) Prior Publication Data

US 2010/0032303 A1 Feb. 11, 2010

(51) Int. Cl.
*C25D 5/18* (2006.01)
*C25D 21/12* (2006.01)

(52) U.S. Cl. ..... 205/96; 204/230.7

(58) Field of Classification Search ..... None
See application file for complete search history.

(56) References Cited

U.S. PATENT DOCUMENTS 3,880,725 A 4/1975 Van Raalte et al.
4,304,641 A 12/1981 Grandia et al.
4,696,729 A 9/1987 Santini
5,078,852 A * 1/1992 Yee et al. ..... 204/297.05
5,169,684 A 12/1992 Takagi
5,312,352 A 5/1994 Leschinsky et al.
5,312,532 A 5/1994 Andricacos et al.
5,620,581 A 4/1997 Ang
5,774,019 A 6/1998 Koyama et al.
6,004,440 A 12/1999 Hanson et al.
6,027,631 A * 2/2000 Broadbent ..... 205/137
6,071,388 A 6/2000 Uzoh
6,074,544 A 6/2000 Reid et al.

(Continued)

FOREIGN PATENT DOCUMENTS

CA 1 236 627 7/1986

(Continued)

OTHER PUBLICATIONS

Reid et al., "Method and Apparatus for Electroplating," Novellus Systems, Inc., U.S. Appl. No. 12/291,356, filed Nov. 7, 2008.

(Continued)

*Primary Examiner*—Harry D Wilkins, III
(74) *Attorney, Agent, or Firm*—Weaver Austin Villeneuve & Sampson LLP

(57) ABSTRACT

An apparatus for electroplating a layer of metal on the surface of a wafer includes a second cathode located remotely with respect to the wafer. The remotely positioned second cathode allows modulation of current density at the wafer surface during an entire electroplating process. The second cathode diverts a portion of current flow from the near-edge region of the wafer and improves the uniformity of plated layers. The remote position of second cathode allows the insulating shields disposed in the plating bath to shape the current profile experienced by the wafer, and therefore act as a "virtual second cathode". The second cathode may be positioned outside of the plating vessel and separated from it by a membrane.

20 Claims, 5 Drawing Sheets

U.S. PATENT DOCUMENTS

| | | | | |
|---|---|---|---|---|
| 6,099,702 | A | 8/2000 | Reid et al. | |
| 6,110,346 | A | 8/2000 | Reid et al. | |
| 6,126,798 | A | 10/2000 | Reid et al. | |
| 6,156,167 | A | 12/2000 | Patton et al. | |
| 6,162,344 | A | 12/2000 | Reid et al. | |
| 6,168,693 | B1 | 1/2001 | Uzoh et al. | |
| 6,174,425 | B1 | 1/2001 | Simpson et al. | |
| 6,179,983 | B1 * | 1/2001 | Reid et al. | 205/96 |
| 6,261,433 | B1 * | 7/2001 | Landau | 205/96 |
| 6,322,674 | B1 | 11/2001 | Berner et al. | |
| 6,391,166 | B1 | 5/2002 | Wang | |
| 6,402,923 | B1 | 6/2002 | Mayer et al. | |
| 6,497,801 | B1 * | 12/2002 | Woodruff et al. | 204/230.2 |
| 6,551,483 | B1 * | 4/2003 | Mayer et al. | 205/81 |
| 6,569,299 | B1 | 5/2003 | Reid et al. | |
| 6,599,412 | B1 * | 7/2003 | Graham et al. | 205/123 |
| 6,716,334 | B1 | 4/2004 | Reid et al. | |
| 6,843,894 | B2 | 1/2005 | Berner et al. | |
| 7,323,094 | B2 * | 1/2008 | Simpson et al. | 205/80 |
| 2006/0243598 | A1 * | 11/2006 | Singh et al. | 205/260 |

FOREIGN PATENT DOCUMENTS

| | | |
|---|---|---|
| WO | WO 99/14401 | 3/1999 |
| WO | WO 99/64647 | 12/1999 |

OTHER PUBLICATIONS

Mayer et al., "Method and Apparatus for Electroplating," Novellus Systems, Inc., U.S. Appl. No. 12/481,503, filed Jun. 9, 2009.
Mayer et al., "Method and Apparatus for Electroplating," Novellus Systems, Inc., U.S. Appl. No. 12/606,030, filed Oct. 26, 2009.
Wang, "Plating Apparatus and Method," U.S. Appl. No. 60/074,466, filed Feb. 12, 1998.

* cited by examiner

METHOD AND APPARATUS FOR ELECTROPLATING INCLUDING REMOTELY POSITIONED SECOND CATHODE

FIELD OF THE INVENTION

The present invention relates generally to a method and apparatus for treating the surface of a substrate and more particularly to a method and apparatus for electroplating a layer on a semiconductor wafer. It is particularly useful for electroplating copper in Damascene and dual Damascene integrated circuit fabrication methods.

BACKGROUND OF THE INVENTION

Manufacturing of semiconductor devices commonly requires deposition of electrically conductive material on semiconductor wafers. The conductive material such as copper, is often deposited by electroplating onto a seed layer of metal deposited onto the wafer surface by a PVD or CVD method. Electroplating is a method of choice for depositing metal into the vias and trenches of the processed wafer during Damascene and dual Damascene processing.

Damascene processing is a method for forming interconnections on integrated circuits (IC). It is especially suitable for manufacturing integrated circuits, which employ copper as a conductive material. Damascene processing involves formation of inlaid metal lines in trenches and vias formed in a dielectric layer (inter-metal dielectric). In a typical Damascene process, a pattern of trenches and vias is etched in the dielectric layer of a semiconductor wafer substrate. A thin layer of diffusion-barrier film such as tantalum, tantalum nitride, or a TaN/Ta bilayer is then deposited onto the wafer surface by a PVD method, followed by deposition of seed layer of copper on top of the diffusion-barrier layer. The trenches and vias are then electrofilled with copper, and the surface of the wafer is planarized.

The vias and trenches are electrofilled in an electroplating apparatus, such as the SABRE™ clamshell electroplating apparatus available from Novellus Systems, Inc. of San Jose, Calif., and described in U.S. Pat. No. 6,156,167, which is incorporated herein by reference in its entirety. Electroplating apparatus includes a cathode and an anode immersed into an electrolyte contained in the plating bath. The cathode of this apparatus is the wafer itself, or more specifically, its copper seed layer and the deposited copper layer. The anode may be a disc composed of, e.g., phosphorus-doped copper. The composition of electrolyte may vary, but usually includes sulfuric acid, copper sulfate, chloride ions, and a mixture of organic additives. The electrodes are connected to a power supply, which provides the necessary voltage to electrochemically reduce cupric ions at the cathode resulting in deposition of copper metal on the surface of the wafer seed layer. Ideally, electroplating process should operate at a constant rate across the full wafer surface and should result in uniform thickness of deposited copper layer from the center to the edge of the wafer. Thus, the features near the edge of the wafer should ideally be filled after the same period of process time and under the same current profile as the features near the center of the wafer.

There are several effects, however, that reduce the uniformity of electroplating, leading to increased thickness of deposited copper layer at the edge of the wafer relative to the thickness of copper layer in the center of the wafer. One example is a field effect, which originates from a geometry induced by the shape of electric field in which an increased current flux is present at the edge of the wafer. Unless extensive current shielding is used near the wafer edge, field effect will result in thicker plating in the near-edge area of the wafer.

A terminal effect is also a near-edge effect, the magnitude of which depends on the thickness of the copper seed layer on the wafer. The PVD-deposited copper seed layer can have a thickness typically ranging from about 5 nm to about 150 nm. The sheet resistance of the seed layer increases as its thickness decreases. Using thin seed layers which have a high sheet resistance, a voltage drop exists between the edge of the wafer where electrical contact is made and the center of the wafer. This resistive drop persists during electroplating process until sufficient plating to increase the conductance across the wafer is achieved. The resistive drop results in a larger voltage driving the plating reaction near the edge of the wafer and thus a faster deposition rate at the wafer edge. As a result the deposited layer has a concave profile with an increased thickness near the edge of the wafer relative to its center. The terminal effect substantially increases the plated thickness near the wafer edge in substrates having seed layers or plated layers with a thickness of less then about 1000 Å. The impact of terminal effect in generating thickness variation is mostly concentrated in the outer 15 mm of the wafer diameter, especially in substrates having thin seed layers.

In general, in order to achieve a uniform thickness distribution of plated copper on the wafer surface a uniform voltage profile should exist at the wafer surface during plating. In order to compensate for the terminal effect, it is necessary to compensate for the resistive voltage drop by increasing the voltage or current supplied to the inner regions of the wafer so that an equivalent interfacial potential is maintained across the full wafer surface. Alternatively, one may reduce the sheet resistance by using thick conductive copper seed layers and by choosing symmetry of the anode chamber opening to match the plated wafer surface while adjusting for increased current flux to the edge of the wafer with shielding near the wafer edge. However, thin seed layers are needed for small interconnects which are used in current and future levels of IC miniaturization. Therefore there is a need for methods that will compensate for the terminal effect and lead to uniform deposition of plated metal.

The terminal effect problem has been addressed in a number of ways, which include modifications of electrolyte composition and introduction of new configurations of the plating apparatus.

The plating solution is typically composed of copper sulfate, sulfuric acid, chloride ions and organic additives. Sulfuric acid is added to the electrolyte to enhance conductivity of the plating solution. This allows electrodeposition at reduced applied voltages and improves uniformity of voltage applied to surfaces at varying distances from an anode. Uniform voltages lead to uniform deposition rates. Conversely, when anode and wafer are equidistant at all points, lower concentrations of acid can be used to uniformly increase resistance between the wafer and the anode. This large uniform increase in resistance can diminish the terminal effect of resistive seed layers. Therefore, it is preferred to use electrolytes with low or medium concentrations of sulfuric acid while plating on thin seed layers. For example, an electrolyte having sulfuric acid at a concentration of about 10 g/L corresponding to solution conductivity of about 0.05 $(\text{ohm-cm})^{-1}$ can adequately redistribute current toward the wafer center during electroplating on moderately resistive seed layers that are thicker than about 400 Å. This method alone, however, does not provide sufficient current redistribution for plating on seed layers thinner than 400 Å.

Copper sulfate is added as a convenient source of cupric ions that undergo reduction to copper metal during electroplating. Very low copper sulfate concentrations significantly increase the polarization resistance at the interface during copper deposition and improve center-edge uniformity by reducing the relative importance of the terminal effect. A degree of center versus edge thickness distribution control can also be achieved by modulating mass transfer rate of cupric ions to the interface such that the deposition process rate becomes limited to some degree in areas of lower mass transfer as described in U.S. Pat. Nos. 6,110,346, 6,074,544, and 6,162,344. This method achieves profile control by using currents which can become a significant fraction of the limiting current and is thus dependent on the copper concentration in the plating bath. Typically, a lower current will be required to achieve some degree of profile control based on copper depletion using a lower concentration of copper in the plating bath.

Organic additives, known as accelerators, suppressors, and levelers, may be added to copper electroplating baths to locally accelerate or suppress electrodeposition of copper and thereby modulate the uniformity of the deposition process. However this method of center-edge distribution control is not normally employed since the additives adsorb on the surface of deposited copper and are incorporated into the electroplated layer thereby altering its properties. In general, however, small amounts of additives may be useful for improving overall uniformity during electroplating because they increase the interfacial polarization resistance and thus diminish the relative magnitude of the terminal effect.

A number of electroplating apparatus configurations have been developed in order to improve the uniformity of electroplating. These configurations include shielding, dynamic shielding, and second cathode configurations. Shielding involves positioning dielectric material between the anode and the wafer cathode. The dielectric inserts, known as shields, can have a variety of geometries allowing them to block the current flow between the anode and the wafer over a portion of the edge of the wafer. These shields, however do not adequately improve nonuniformity resulting from terminal effect, since terminal effect is present only in the beginning of electroplating process. After a sufficient amount of copper is deposited onto the seed layer, its resistance is reduced and the terminal effect disappears. The fixed shields or resistive elements have a constant impact during electroplating process, which can lead to undercompensation of terminal effect during plating on thin seed layers and to overcompensation during deposition on thick seed layers. Therefore, there is a need for configuration, which would allow dynamic modulation of current profile at the wafer surface. Specifically, this configuration should allow for decreased current flux at the wafer edge in the beginning of the plating process, which can be increased as the plating process proceeds.

Such dynamic modulation can be achieved to some degree by employing dynamic shielding which involves movement of an iris like mechanism to divert current toward the center of the wafer as needed to compensate for terminal effect or to achieve specific profile shaping. It has also been described that by inserting a resistive element close to a wafer surface and varying resistivity through the element it is possible to modulate thickness distribution across the wafer. In particular, dielectric plates with hole patterns placed near the wafer surface were described as a means to modulate the resistive pathway between the anode and the wafer. Use of segmented anodes with dynamic control has also been described as a means to divert current towards either the center or the edge of a wafer.

None of these methods, however, accomplishes the goal of achieving a uniform current density across all wafer surfaces during an entire deposition process. Although a final uniform thickness profile can be achieved, it is based on the averaging of conditions throughout a process, rather than a continuous uniform process. Methods which employ dynamic shields and segmented anodes result in sharp transitions in thickness of deposited layer in positions corresponding to anode segment edges or at the edges of the variable shield. These methods are also lacking in ability to specifically modulate thickness at the edge of the wafer where terminal and field effects are most significant.

Introduction of appropriately positioned second cathode known as a thief will divert current from the wafer edge to the second cathode surface, and will allow modulation of thickness of deposited layers. Although several electroplating configurations employing thieving cathodes have been described, the position of the second cathode in these configurations is such that it does not allow sufficient level of control over the current density profile. The second cathode in the previously described configurations is positioned adjacent to the wafer and is immersed with the wafer into the main plating bath during the electroplating process. In such a configuration, the amount of current diverted to the second cathode is governed by the size, the shape and the electric potential of the thief. Modulation of these parameters is not always easily achieved. For example, it is not always possible to position a very large second cathode, which may be needed for diverting large currents, in the immediate proximity of the wafer. Additional difficulties may also exist in changing the thieving cathode geometry to accommodate different process needs or in providing a separate current controller for the thieving cathode.

Positioning the second cathode directly near the wafer also results in increased depletion of metal ion-containing material (e.g. $CuSO_4$) at the wafer surface. Such depletion increases the dependency of the electrodeposition reaction on metal ion mass transfer rate, which is generally undesired.

Furthermore, it is often desirable to strip the metal deposited on the second cathode in order to reuse it after electroplating is completed. Such stripping, which involves reversal of second cathode and anode polarities, cannot be readily achieved with existing second cathode configurations.

Therefore, there is a need for an electroplating apparatus and an electroplating method, which will allow modulation of current density profile during the entire electroplating process.

SUMMARY

The present invention addresses these needs, in one aspect, by providing an apparatus for electroplating a layer of metal on the surface of a wafer which includes a second cathode located remotely with respect to the wafer. The remotely positioned second cathode allows modulation of current density at the wafer surface during an entire electroplating process. In one embodiment, this modulation is achieved by providing a dynamically controlled level of current to the second cathode, where the level of current can be gradually diminished during electroplating process in order to compensate for the diminishing terminal effect. The second cathode diverts a portion of current flow from the near-edge region of the wafer and improves the uniformity of plated layers. The remote position of second cathode allows the insulating shields disposed in the plating bath to shape the current profile experienced by the wafer, and therefore act as a "virtual second cathode". In a preferred embodiment, the second cathode is positioned outside of the plating vessel and is separated from it by a membrane. The use of second cathode is especially advantageous for electroplating on thin seed layers, in which improved uniformity is achieved while plating on seeds as thin as about 50 Å.

In one embodiment, the invention provides an apparatus for electroplating metal (e.g. copper), on to a semiconductor wafer having a layer of conductive material (e.g. copper seed layer). The apparatus includes a vessel for holding a plating solution, an anode disposed within the vessel, a wafer holder for holding a semiconductor wafer in the plating solution within the vessel during electroplating and a second cathode disposed outside of the vessel. The second cathode can be separated from the plating vessel, at least in part, by a membrane which provides ionic communication between the plating solution in the vessel and the second cathode. The membrane allows the flow of current between the plating vessel and the second cathode, but prevents particulate material, which might be formed at the second cathode surface, from entering the main plating vessel and contaminating the wafer. A separate chamber providing an annularly shaped region on the outside of the plating vessel and mounted to the plating vessel wall at substantially the same vertical elevation as the wafer elevation during plating within the vessel, can be used for housing the second cathode. The wall separating the second cathode chamber from the main plating vessel can be perforated with multiple holes, wherein each hole has a membrane or a membrane section provided thereon. The second cathode chamber is in fluid communication with the primary plating vessel through a weir, and is configured to be replenished with the plating solution, at least in part, by overflow of plating solution from the primary plating vessel. The plating solution in the main plating vessel may in turn be replenished by a recirculating mechanism, in which the solution overflows from the main vessel to a reservoir and is returned back to the main plating vessel upon filtration or other treatment.

The second cathode can be a strip of metal which is preferably inert under electroplating conditions. Examples of inert metals which can be used as a second cathode include titanium, platinum, platinized titanium, iridium and iridized titanium. The electroplating apparatus includes one or more power supplies configured to deliver a first level of current to the semiconductor substrate and a second level of current to the second cathode. The power supplies are also connected to the anode. In order to prevent undesired current reversal, which might occur with the anode being the common element of both the wafer and the second cathode circuits, one ore several diodes configured to prevent such current reversal, can be employed. The diodes may be configured to operate only when current reversal is not desired (e.g. during electroplating) and may be turned off if current reversal is needed (e.g. during stripping of second cathode).

In some embodiments the main plating vessel includes one or more insulating inserts that shape electric field lines between the semiconductor substrate and the second cathode, thereby defining a "virtual second cathode". The inserts are usually insulating rings disposed about the periphery of the semiconductor substrate between the anode and the substrate. Other insert shapes, such as wedges, bars, ellipses and rings with patterned inside diameter, can be used. Discs having multiple perforations, such as a diffuser plate or high resistance virtual anode (HRVA), are other examples of inserts that can be used in some embodiments of the present invention. Other apparatus configurations that may be used in accordance with the present invention include configurations with segmented anode, or configurations with one or more virtual anodes.

In one embodiment, the electroplating apparatus may include an anode chamber within the plating vessel, which can be separated from the cathodic region of the vessel by a membrane. An ion selective membrane allows the flow of ions between the anode and the cathode, but prevents larger particles that may be formed at the anode surface, from entering the proximity of the wafer substrate and contaminating it.

In accordance with the present invention, the electroplating apparatus may also include a reference electrode configured with respect to the semiconductor substrate to permit potentiostatic control of the plating process. The reference electrode can be connected to a controller, which may be configured to provide potentiostatic control of current flow during immersion of the substrate into the plating solution and galvanostatic control of the current flow after immersion. The controller may also be configured to dynamically control the amount of current flow to the second cathode during plating to account for a gradual reduction of the non-uniform current distribution.

In another aspect, the invention provides a method of electroplating a layer of metal on to a semiconductor wafer having a layer of conductive material in an apparatus having a remotely positioned second cathode. The method includes immersing the wafer into the plating solution, and applying a first level of current to the wafer, and a second level of current to the second cathode. The current is applied so that the wafer and the second cathode are both biased negatively with respect to the plating solution. The deposition of metal occurs both on the surface of the wafer and on the second cathode. The current flow between the plating solution and the wafer is partially diverted to the second cathode leading to decreased deposition of metal in the near-edge region of the wafer. Improved center—edge uniformity of deposited layers can be attained when current diverted to the second cathode compensates, at least in part, for the terminal and field effects.

In one embodiment of present invention, the immersion of the wafer is performed under potentiostatic control. Upon potentiostatic immersion of the wafer, the process transitions to current-controlled plating. The current can be applied to the second cathode concurrently with this transition. The level of current applied to the second cathode can be dynamically controlled over the course of the metal deposition in order to gradually reduce the effect of the second cathode to compensate account for the diminishing non-uniformity in the current density distribution at the wafer surface. When electroplating is completed, the semiconductor substrate is removed from the plating solution, and the second cathode can be stripped of the deposited metal by reversing the polarity between the anode and the second cathode.

These and other features and advantages of the present invention will be described in more detail below with reference to the associated drawings.

DETAILED DESCRIPTION OF A PREFERRED EMBODIMENT

Figure 1A:
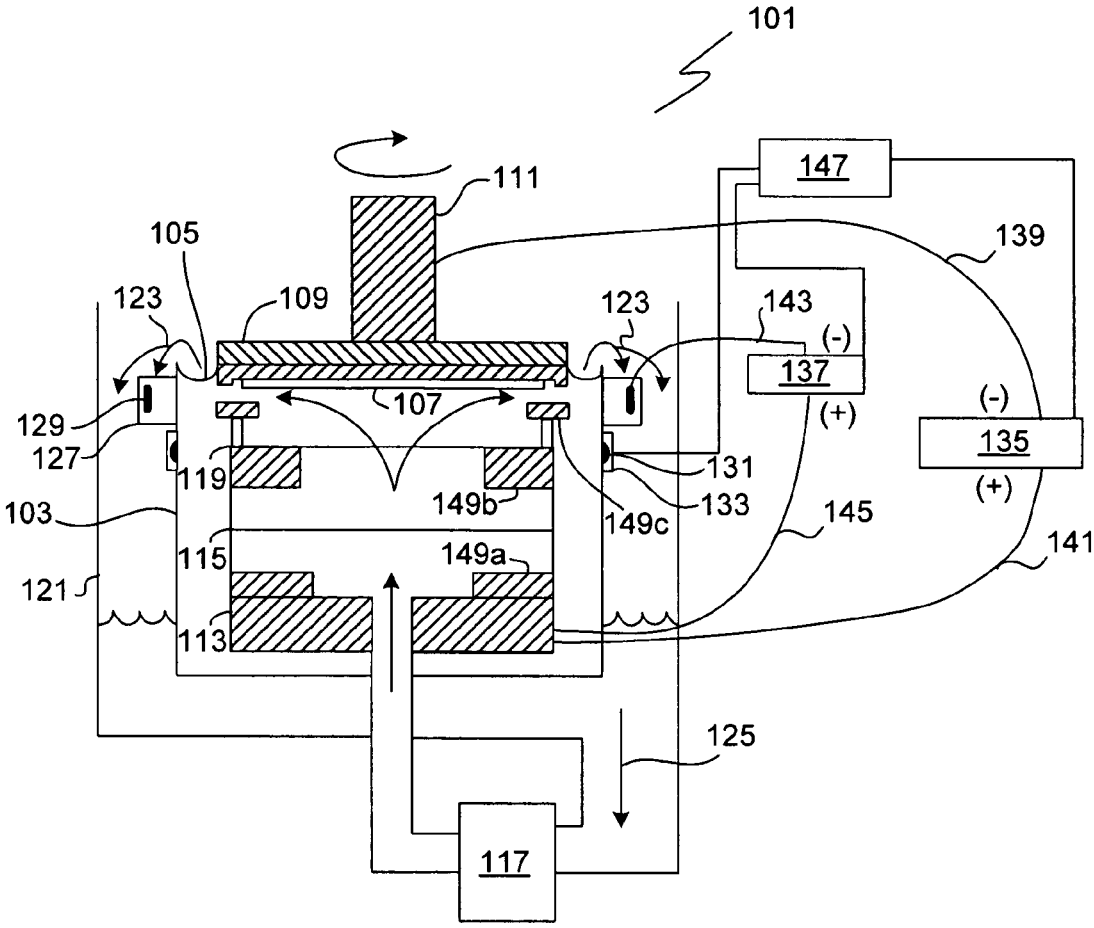
FIG. 1*a* is a diagrammatic cross-sectional view of an electroplating apparatus having a second cathode mounted outside of the main plating vessel in accordance with the present invention.

This invention employs a remotely positioned second cathode, capable of modulating current density at the surface of the wafer. One general advantage of the second cathode is that it allows fine control of the compensating effect by tuning the current or potential at the second cathode. Thus, it is relatively easy to move from providing a large effect at the beginning of the deposition process when the current is carried primary by the seed layer to a smaller effect after some amount of copper has been plated and the terminal effect is diminished. The remote position of this cathode in accordance with embodiments of this invention allows the insulating shields and resistive elements disposed in the plating bath to operate in conjunction with the cathode and shape the current profile experienced by the wafer, and therefore act as a "virtual second cathode". In a preferred embodiment, the second cathode is disposed outside of the main plating vessel and is separated from the main plating bath by a membrane, that allows the flow of ions, and, hence, the current, but blocks particulate material that might otherwise contaminate the wafer. The second cathode effectively compensates for the terminal effect by diverting current flow from the near-edge portion of the wafer thereby improving the center—edge uniformity of electrodeposition process. The use of second cathode is especially advantageous when electroplating is performed on thin resistive seed layers, in which improved uniformity can be achieved while plating on seed layer as thin as, for example, 50 Å. Specific embodiments of this invention, will be presently described in detail.

Referring to FIG. 1, a diagrammatical cross-sectional view of an electroplating apparatus 101 is shown. The plating vessel 103 contains the plating solution, which is shown at a level 105. A wafer 107 is immersed into the plating solution and is held by a "clamshell" holding fixture 109, mounted on a rotatable spindle 111, which allows rotation of clamshell 109 together with the wafer 107. A general description of a clamshell-type plating apparatus having aspects suitable for use with this invention is described in detail in U.S. Pat. No. 6,156,167 issued to Patton et al., and U.S. Pat. No. 6,800,187 issued to Reid et al, which are incorporated herein by reference for all purposes. An anode 113 is disposed below the wafer within the plating bath 103 and is separated from the wafer region by a membrane 115, preferably an ion selective membrane. The region below the anodic membrane is often referred to as an "anode chamber" and electrolyte within this chamber as "anolyte". The ion-selective anode membrane 115 allows ionic communication between the anodic and cathodic regions of the plating cell, while preventing the particles generated at the anode from entering the proximity of the wafer and contaminating it. The anode membrane is also useful in redistributing current flow during the plating process and thereby improving the plating uniformity. Detailed descriptions of suitable anodic membranes are provided in U.S. Pat. Nos. 6,126,798 and 6,569,299 issued to Reid et al., both incorporated herein by reference for all purposes.

The plating solution is continuously provided to plating bath 103 by a pump 117. Generally, the plating solution flows upwards through an anode membrane 115 and a diffuser plate 119 to the center of wafer 107 and then radially outward and across wafer 107. In alternative embodiments, the plating solution may be provided into anodic region of the bath from the side of the plating cell 103. In other embodiments plating solution may be supplied through separate inlets into anodic and cathodic regions of the plating cell.

The plating solution then overflows plating bath 103 to an overflow reservoir 121 as indicated by arrows 123. The plating solution is then filtered (not shown) and returned to pump 117 as indicated by arrow 125 completing the recirculation of the plating solution.

A second cathode chamber 127, housing the second cathode 129 is located on the outside of the plating vessel 103. The plating solution overflows a weir wall of the plating vessel into the second cathode chamber. In certain embodiments, the second cathode chamber is separated from the plating bath 103 by a wall having multiple openings covered by an ion-permeable membrane. The membrane allows ionic communication between the plating cell and the second cathode chamber, thereby allowing the current to be diverted to the second cathode. The porosity of this membrane is such that it does not allow particulate material to cross from the second cathode chamber 127 to the plating bath 103 and result in the wafer contamination. The openings in the walls may take the form of rounded holes, slots, or other shapes of various sizes. In one embodiment, the openings are slots having dimensions of, e.g., about 12 mm by 90 mm. Other mechanisms for allowing fluidic and/or ionic communication between the second cathode chamber and the main plating vessel are within the scope of this invention. Examples include designs in which the membrane, rather than an impermeable wall, provides most of the barrier between plating solution in the second cathode chamber and plating solution in the main plating vessel. A rigid framework may provide support for the membrane in such embodiments.

A reference electrode 131 is located on the outside of the plating vessel 103 in a separate chamber 133, which chamber is replenished by overflow from the main plating vessel. A reference electrode is typically employed when electroplating at a controlled potential is desired.

Two DC power supplies 135, and 137 can be used to control current flow to the wafer 107 and to the second cathode 129 respectively. A power supply 135 has a negative output lead 139 electrically connected to wafer 107 through one or more slip rings, brushes and contacts (not shown). The positive output lead 141 of power supply 135 is electrically connected to an anode 113 located in plating bath 103. Similarly, a power supply 137 has a negative output lead 143 electrically connected to the second cathode, and a positive output lead 145 electrically connected to an anode 113. Alternatively, one power supply with multiple independently controllable electrical outlets can be used to provide different levels of current to the wafer and to the second cathode. The power supplies 135, and 137, and a reference electrode 131 can be connected to a controller 147, which allows modulation of current and potential provided to the elements of electroplating cell. For example, the controller may allow electroplating either in galvanostatic (controlled current) or potentiostatic (controlled potential) regime. The controller may include program instructions specifying current and voltage levels that need to be applied to various elements of the plating cell, as well as times at which these levels need to be changed. For example, it may include program instructions for transitioning from potential-control to current-control upon immersion of the wafer into the plating bath.

During use, the power supplies 135 and 137 bias both the wafer 107 and the second cathode 129 to have a negative potential relative to anode 113. This causes an electrical current flowing from anode 113 to the wafer 107 to be partially or substantially diverted to the second cathode 129. The electrical circuit described above may also include one or several diodes that will prevent reversal of the current flow, when such reversal is not desired. An undesired current feedback may occur during plating, since the anode 113 which is set at ground potential is the common element of both the wafer and the thief circuits.

The level of current applied to the second cathode is typically set to lower values than the level of current applied to the wafer, with the second cathode current being presented as a percentage of the wafer current. For example, a 10% second cathode current corresponds to a current flow at the second cathode that is 10% of the current flow to the wafer. The direction of the current as used herein is the direction of net positive ion flux. During electroplating, an electrochemical reduction (e.g. $Cu^{2+}+2e^{-}=Cu^{0}$) occurs both on the wafer surface (first cathode) and on the second cathode surface, which results in the deposition of the electrically conductive layer (e.g. copper) on the surfaces of both the wafer and the thief. Since the current is diverted from the wafer to the second cathode, the thickness of deposited copper layer at the edge of the wafer is diminished. This effect typically occurs in the outer 20 mm of the wafer, and is especially pronounced in its outer 10 mm, particularly when plating is performed on thin seed layers. The use of thieving cathode 129 can substantially improve center—edge nonuniformity resulting from terminal and field effects. Second cathode can be used either alone or in conjunction with a variety of fixed or dynamic shields.

Shields 149*a-c* and a diffuser plate 151 are illustrated in FIG. 1. The shields are usually ring-shaped dielectric inserts, which are used for shaping the current profile and improving the uniformity of plating, such as those described in U.S. Pat. No. 6,027,631 issued to Broadbent. Of course other shield designs and shapes may be employed as are known to those of skill in the art. A diffuser plate is a disk-shaped dielectric plate having multiple openings or a rigid plastic or ceramic porous membrane material, which is also useful for improving the uniformity of current profile, and, hence, the uniformity of plating.

In general, the shields may take on any shape including that of wedges, bars, circles, ellipses and other geometric designs. The ring-shaped inserts may also have patterns at their inside diameter, which improve the ability of the shields to shape the current flux in the desired fashion. The function of the shields may differ, depending on their position in the plating cell. Shields may be positioned in the proximity of the anode such as 149*a* or in the proximity of the wafer such as 149*c*. Shields positioned between an anode and a cathode such as shields 149*b*, are sometimes referred to as a "virtual anode" since they define the geometry of the current flux experienced by the wafer. Virtual anodes may be rings or discs having multiple perforations, such as those described in further detail in U.S. Pat. No. 6,179,983 issued to Reid et al. Disc-shaped resistive elements having multiple perforations which are disposed in the proximity of the wafer are often called high-resistance virtual anode (HRVA) plates and can be used in place of a typical diffuser. The apparatus of the present invention can include any of the shields or plates mentioned above, as well as variable field shaping elements, such as those described in U.S. Pat. No. 6,402,923 issued to Mayer et al., or segmented anodes, such as described in a U.S. Pat. No. 6,497,801 issued to Woodruff et al.

The apparatus configuration described above is an illustration of one embodiment of the present invention. Those skilled in the art will appreciate that alternative plating cell configurations that include an appropriately positioned second cathode may be used. While shielding inserts are useful for improving plating uniformity, in some embodiments they may not be required, or alternative shielding configurations may be employed. In an embodiment described above the second cathode is positioned in a chamber outside of the main plating bath. Other embodiments having a remotely positioned second cathode are also encompassed by present invention.

For an apparatus processing 300 mm wafers, second cathode can be positioned at a distance of at least about 2 cm from the edge of the wafer, more preferably at a distance of about 2-8 cm. Those skilled in the art will understand how to scale these parameters for processing workpieces of different dimensions. A remote position of the second cathode relative to the wafer allows the insulating inserts shaping the field profile in the electroplating cell to act as a "virtual second cathode". In a virtual second cathode configuration, it is not just the size and shape of the actual second cathode but primarily the size and shape of the inserts that define the current profile in the vicinity of the wafer. It is, therefore, possible in this configuration to vary the profile of diverted current by changing or modifying the insulating inserts of the plating cell without changing or modifying the size or geometry of the thief cathode. This is advantageous, since insert replacement is usually less laborious and time-consuming than second cathode replacement.

Remote positioning of second cathode has several additional advantages over previously described second cathode configurations. In particular, a large second cathode may be needed if large currents have to be diverted from the wafer. While it may be difficult to position a large cathode in the direct proximity of the wafer, it can be easily positioned remotely, for example outside of the main plating bath. Remote positioning of the second cathode also does not lead to undesired increased depletion of metal ions at the wafer surface, which is often observed when the second cathode is located directly proximal to the wafer.

Figure 1B:
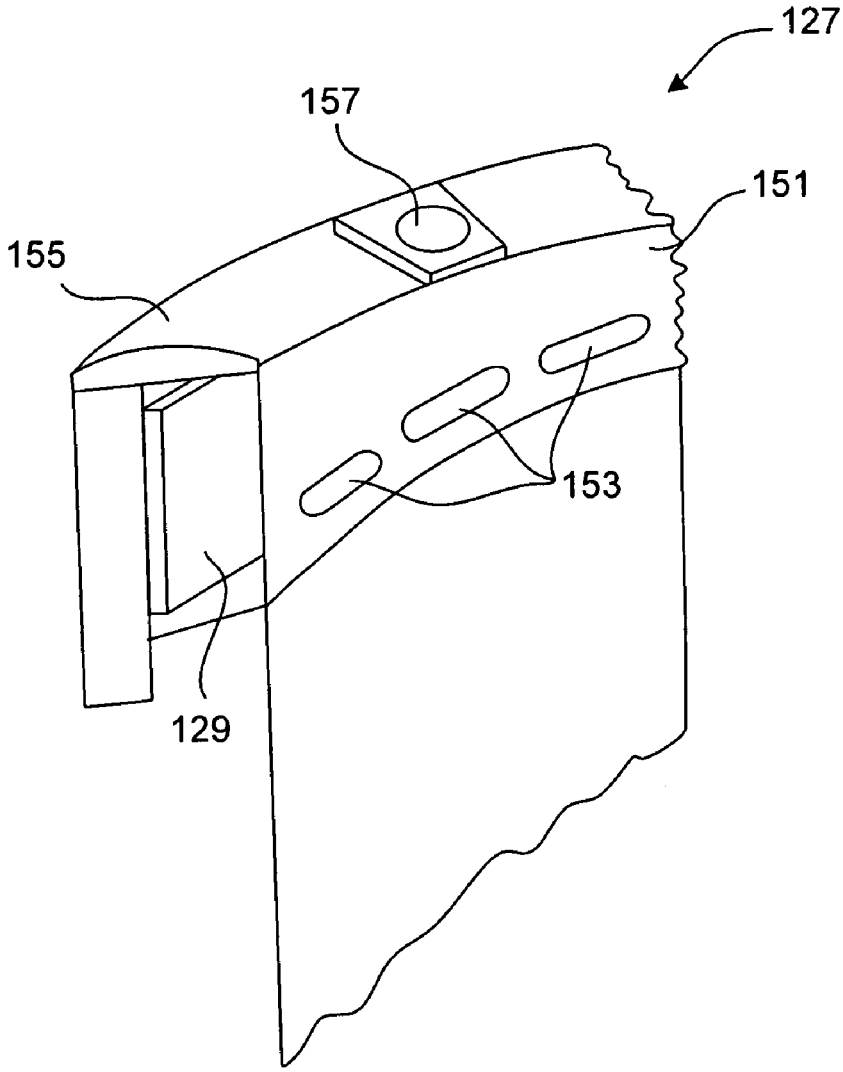
FIG. 1*b* is a sectional view of the second cathode chamber housing the second cathode in accordance with the present invention.

An example of a remotely positioned second cathode is illustrated in FIG. 1B, which shows a sectional view of the second cathode chamber 127 of FIG. 1A. The chamber provides an annularly shaped space located outside of the plating bath and extending around the perimeter of the plating bath at substantially the same vertical elevation as the wafer, where the vertical elevation of the wafer refers to its position within the vessel during plating. The second cathode chamber is mounted on the outside of the plating vessel wall 151, and is designed to be in ionic communication with the plating vessel through a series of membrane-covered openings 153 in the wall 151. The second cathode chamber is replenished with the plating solution at least in part by an overflow from the main plating vessel. The top portion of the second cathode chamber is covered by an electrode cover 155, which has a number of openings, such as opening 157. The plating solution overflows into the second cathode chamber through weir walls located at these openings. Rapid refreshment of the plating solution, which can be achieved by rapid overflow into the second cathode chamber, prevents passivation of the second cathode 129 which can occur during electroplating and stripping processes. The rate of overflow may be controlled, for example, by varying the percentage of open area in the electrode cover 155. Thus, for example, at least about 5, 10, 50 or 100% of an electrode cover area may be open for overflow.

Ionic communication between second cathode 129 and the main plating bath is effected by membrane openings 153. The membrane covering these openings has a porosity sufficient for ionic species, such as cupric ions or protons, to cross the membrane and provide current flow to the second cathode. This membrane, however, is capable of blocking larger particles, which may be generated at the second cathode surface from passing through the membrane to the main plating cell and contaminating the wafer. Generally, it is desirable to prevent particulates greater in size than 0.05 microns from passing through the membrane. This can be achieved by employing a membrane composed of a polymeric material with an average pore or channel size of not greater than about 0.05 microns, and preferably as small as 1-10 nm. In certain embodiments, porous polymeric material is made from a polyolefin or other wettable polymeric material that is resistant to attack from the plating solution. Suitable examples of membrane material include: napped polypropylene available from Anode Products, Inc. located in Illinois; spunbound snowpro polypropylene and various polyethylene, polysulfone, RYTON, and TEFLON materials in felt, monofilament, filament and spun forms available from various suppliers including Entegris of Chaska, Minn. In particular, ionomeric cation exchange membranes, such as Nafion supplied by DuPont de Nemours Co. are useful for this application.

In one embodiment, the second cathode 129 is an annularly shaped strip of metal located within the second cathode chamber 127 and connected to a power supply by, for example, a feed-through connector attached to an electrode cable (not shown). The metal composing the second cathode or its surface is preferably inert under electroplating conditions. Examples of inert metals which can be used as a second cathode include titanium, platinum, platinized titanium, iridium iridized titanium and the like.

The dimensions of the second cathode chamber and of the second cathode may vary depending on the needs of electroplating process. In one example, the second cathode is a strip of metal, having a thickness of about 0.1-2 mm, and a height of about 0.5-5 cm. The second cathode chamber in this embodiment can have a width of about 0.5-3 cm and a depth of about 1-9 cm. Such chamber can be mounted onto the main plating vessel, having an outer diameter of 45-61 cm and a depth of about 30-61 cm. Examples of other cathode configurations include circular bars (toroids), coils having a circular configuration in which individual coils define a small circle and the overall coiled structure surrounds the main plating vessel in the second cathode chamber.

While methods and apparatus of the present invention can be used for electroplating a variety of metals, such as Au, Sn, and PbSn alloy, an example describing electrodeposition of copper on a wafer having a seed layer (e.g., a copper seed layer) will be described.

Electroplating can be performed on substrates having layers of conductive material, such as copper seed layers. Copper seed layers are usually deposited by PVD, CVD or ALD methods to a thickness of about 5 nm-150 nm. While methods of present invention can be used for plating on highly conductive layers, such as layers having thickness of about 2000-10000 Å, they are especially advantageous for depositing copper on thin resistive seed layers having thickness of less than about 400 Å. Methods of present invention allow electrodeposition of copper layers with improved center-edge uniformity on very thin seed layers, such as seed layers 50-500 Å thick, for example on highly resistive 50-100 Å seed layers.

In one embodiment of present invention, electroplating is performed using a plating solution, which includes a source of cupric ions (e.g. copper sulfate or copper pyrophosphate), and may also include additives, which may increase the conductivity of electrolyte (e.g. sulfuric acid) or modulate the rate of electrodeposition in various recesses of the wafer (organic additives or chloride ions). For example, plating solution may include copper sulfate at a concentration range of about 0.5-80 g/L, preferably at about 5-60 g/L, and more preferably at about 18-55 g/L. It may also include sulfuric acid at a concentration of about 0.1-400 g/L, preferably at about 0.1-200 g/L, and more preferably at about 10-175 g/L. Other additives may be optionally included, such as chloride ion at a concentration range of about 1-100 mg/L and one or several organic additives, such as Enthone Viaform, Viaform NexT, Viaform Extreme (available from Enthone, West Haven, Conn.), or other accelerators, suppressors and levelers known to those of skill in the art. In a particular example, plating solution includes copper sulfate at a concentration of about 40 g/L, sulfuric acid at a concentration of about 10 g/L, and chloride ion at a concentration of about 50 mg/L.

Figure 2:
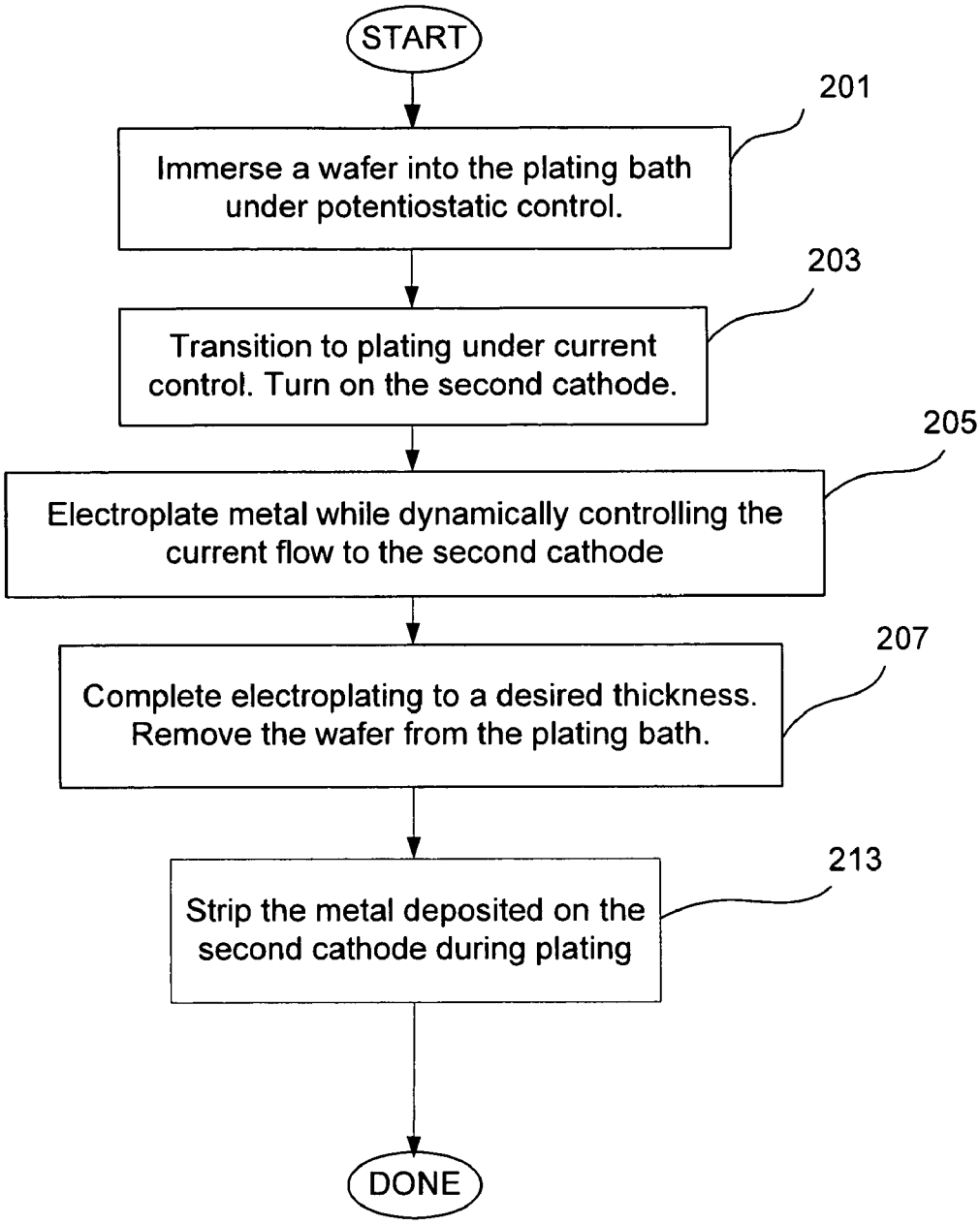
FIG. 2 presents a process flow diagram illustrating electroplating process in accordance with the present invention.

Electroplating process can be performed, in one example, according to a process flow diagram shown in FIG. 2. As shown in the first operation 201, the wafer is immersed into the plating cell under potentiostatic control. The potential of the wafer during entry is controlled with respect to a reference electrode (e.g., a copper reference electrode). Examples of entry potential values that can work well with the present invention include potential values lying in the range of about 0.25-(−1) volts. Typically, the second cathode is turned off during potentiostatic immersion of the wafer. Potentiostatic immersion is desirable, since during first milliseconds of immersion only small portion of the wafer may be sufficiently wetted to allow current flow. If no potential control is in effect, the current density at the wetted portion of the wafer will be substantially higher than at the unwetted regions of the wafer leading to increased rate of electroplating at the wetted position and possible damage to the wafer. This effect may eventually result in undesirable nonuniformity of electrodeposition. In alternative embodiments, wafer entry can be performed at a fixed current, with suitable current density lying in the range of about 0.25-15 $mA/cm^2$.

Upon potentiostatic immersion, which may last about 0.01-2 seconds in some embodiments, the plating process is switched from potential control to current control as shown in operation 203. At this point, current can also be applied to the second cathode. The level of current applied to the wafer may range from about 2.25 to about 9 A, while the level of current applied to the second cathode can vary from about 0.045 to about 3 A. Higher current may be subsequently applied to the wafer (about 9-50 A) and the thief (up to about 5 A)

After current is applied to both cathodes, copper is electrodeposited both on the wafer surface and on the surface of the second cathode. The amount of current, and hence the amount of deposited copper, which is diverted to the second cathode, can be controlled during plating by varying the current level applied to the thief cathode. The level of current applied to the thief may remain constant during the entire plating process, or the thief may be turned off after the terminal effect disappears. Furthermore, the current applied to the thief may be dynamically controlled, as shown in operation 205. For example, the level of thief current can be decreased during plating process in order to accurately compensate for the diminishing terminal effect. Such decrease can be accomplished, for example, in a step-wise fashion or in a continuous ramp-like process. The dynamic modulation of current level applied to the second cathode can be performed by a controller connected to the appropriate power supply. The controller may include program instructions for modulation of second cathode performance, that may specify current levels applied to the second cathode and times for transitioning between these current levels.

After the copper layer has been deposited to a desired thickness on the wafer substrate, the wafer can be removed from the plating bath in operation 207. The second cathode can then be cleaned by removing the layer of copper deposited on its surface. The stripping operation 213 is usually performed by reversing the polarity between the anode and the thief. The copper deposits are dissolved from the thief surface and are eventually plated onto the anode. In certain embodiments, the stripping process can be performed at a thief current density of about 5-200 mA/cm$^2$. The stripping process may be performed either under potential control or under current control. In the case of current control, the reference electrode will indicate the voltage at which the cleaning is complete, preventing uncontrolled stripping which may result in dissolution of the main body of the thieving cathode. Since second cathode is, preferably, composed of an inert metal, it is not dissolved under stripping conditions, when current or voltage-control is in effect. It is possible to automatically control the amount of metal stripped from the second cathode, when the amount of plated metal and the voltage required to sustain stripping current are known. The amount of plated metal can be easily determined by measuring the number of Coulombs that pass through the second cathode. A controller connected to the power supplies and to the reference electrode can be configured to automatically strip the desired amount of metal from the second cathode. The controller can be further configured to automatically determine when stripping should be initiated, based on the amount of metal plated to the second cathode. For example, the controller may comprise program instructions specifying a number of parameters for the stripping process, allowing second cathode stripping in a variety of regimes under voltage control, etc.

The stripping operation is preferably performed when significant flow of the plating solution into the second cathode chamber exists, which prevents passivation of the second cathode by copper precipitates. The membrane separating the second cathode chamber from the main plating solution preferably should not create a large voltage drop, and should allow for flow of the current sufficient for effective stripping. Stripping can be performed in desired intervals and should not necessarily be carried out after processing of each wafer. For example, stripping can be performed after a certain amount of plating has taken place, where such amount can be determined by measuring the amount of current flow through the second cathode.

The process flow diagram shown in FIG. 2 is provided as an example. It should be understood, that alternative processes that may lack some of the steps described above or that may have additional or modified steps, are possible and are not excluded from the scope of present invention.

Figure 3A:
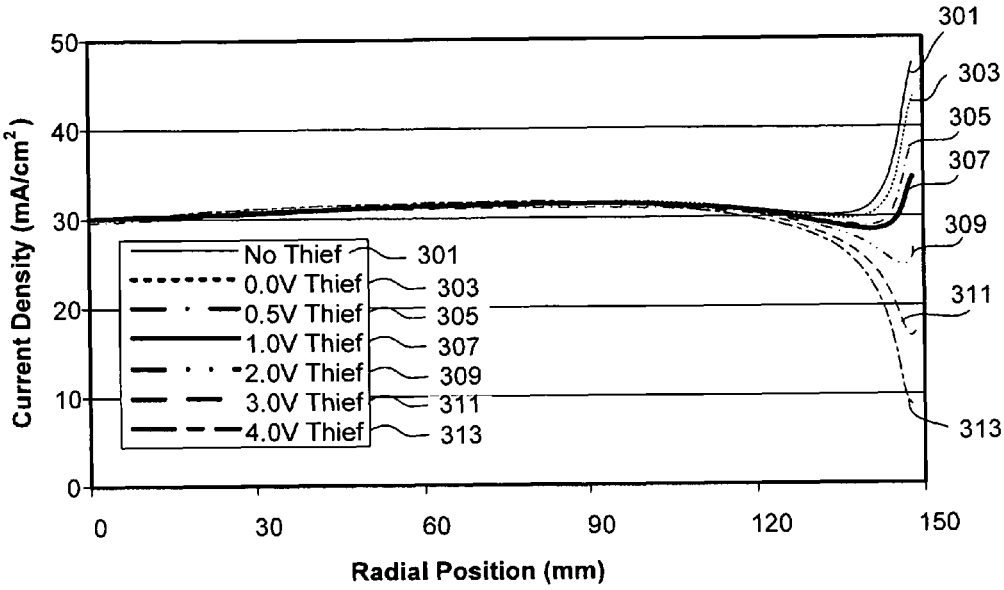
FIG. 3*a* is a graph illustrating predicted current profile for plating on a 200 Å thick seed layer.
Figure 3B:
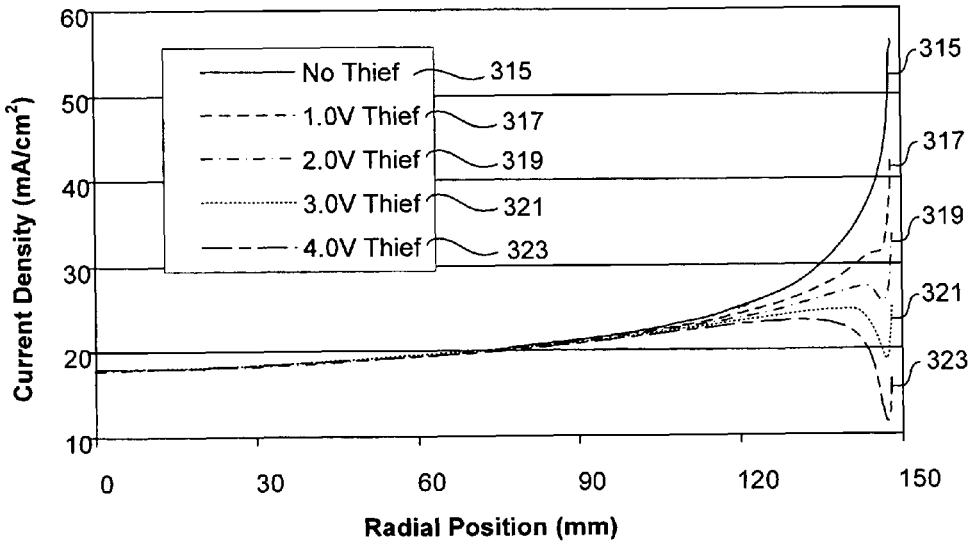
FIG. 3*b* is a graph illustrating predicted current profile for plating on a 5000 Å thick seed layer.

The use of the second cathode results in reduced current density at the near edge of the wafer when plating is performed on both thin (e.g. 200 Å) and thick (e.g. 5000 Å) seeds. Referring to FIGS. 3A and 3B, predicted current density distributions as a function of radial position on a 300 mm wafer are shown. FIG. 3 A illustrates predicted current density profile during plating on a 5000 Å seed with and without the application of current to a second cathode located beyond the perimeter of the wafer. FIG. 3 B illustrates analogous predicted current density profile for plating on a more resistive 200 Å seed layer. Although near edge shielding is assumed to be present in both cases, the current flow to the outer portion of the wafer is substantially higher than the current flow to the inner portion of the wafer, when no voltage is applied to the second cathode (curves 301 and 315). This is especially pronounced for plating on resistive 200 Å seeds, as illustrated by curve 315. As the voltage applied to the second cathode increases (curves 303-313 and 317-323) and higher currents are forced to flow to the second cathode, the current density near the edge of the wafer is predicted to decrease and can even become less than the nominal current density across the wafer. It can be noted that the impact of the second cathode extends only up to about 20 mm inward from the edge of the wafer. It is possible to extend this impact further inward by employing higher second cathode currents, plating solutions with higher conductivity or by placing shields and resistive elements, such as a diffuser plate, at a greater distance from the wafer. In most applications, the impact of the second cathode can compensate for terminal and field effects, which are also confined to the near-edge region of the wafer.

Figure 4:
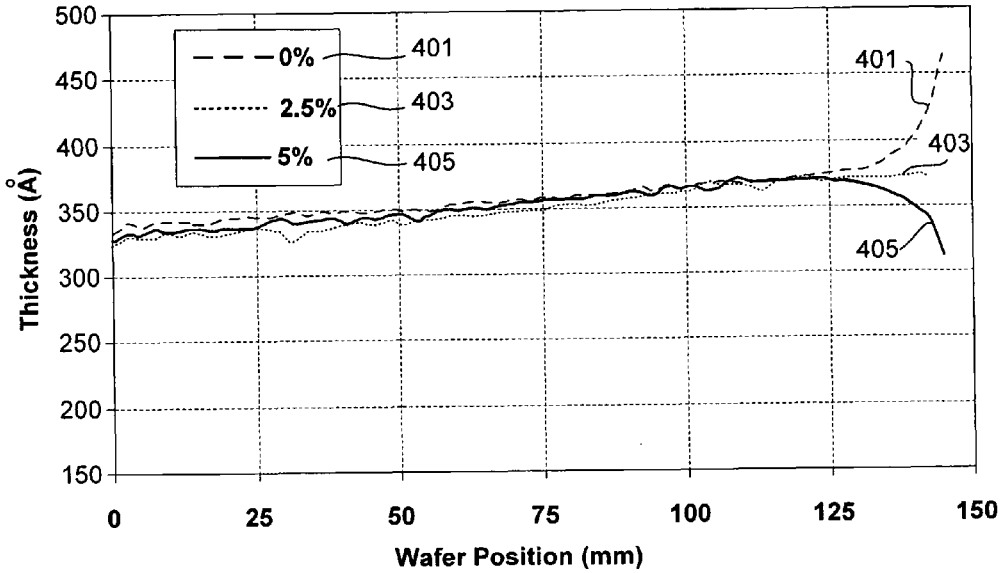
FIG. 4 is an experimental graph illustrating thickness profiles obtained during electrodeposition on a 200 Å seed layer with plating solution having 10 g/L acid concentration.

In accordance with theoretical predictions, experimental data confirmed that electroplating performed with the use of the second cathode results in a decrease of the plated thickness in the near-edge region of the wafer. The current level applied to the second cathode can be selected to adequately compensate for the terminal effect, which will lead to highly uniform electrodeposition of copper layer. This is illustrated in FIG. 4, which presents thickness profiles of deposited copper layers as a function of radial position on the wafer. Experimental data for deposition of 200 Å of copper on a 200 Å copper seed with a plating bath sulfuric acid concentration of 10 g/L is presented. Curve 401 corresponds to electroplating with no current applied to the second cathode. Increased thickness of the plated layer at the wafer edge can be observed in this case. When current equal to 2.5% of the current applied to the wafer, is applied to the second cathode, a highly uniform layer is deposited, as illustrated by curve 403. Applying 5% of the wafer current to the second cathode results in overcompensation of terminal effect, and in an edge-thin profile of deposited layer, as illustrated by curve 405.

Figure 5:
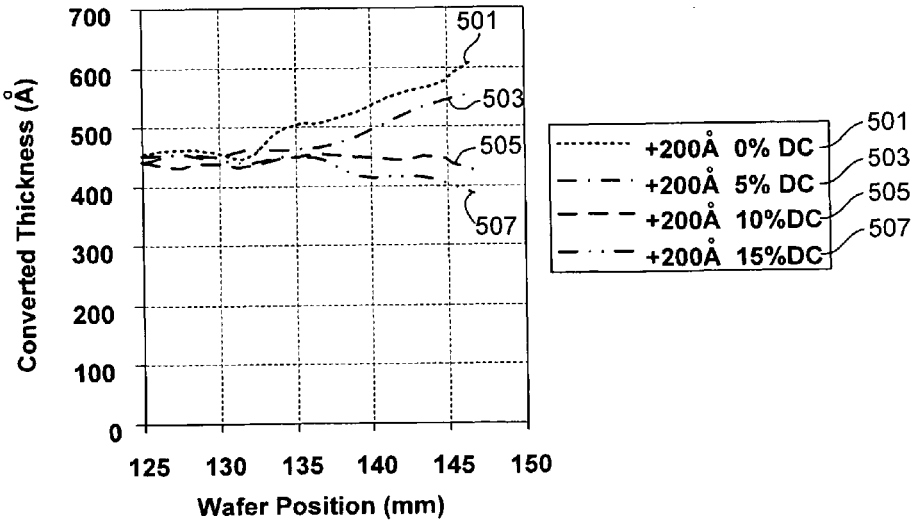
FIG. 5 is an experimental graph illustrating thickness profiles obtained during electrodeposition on a 300 Å seed layer with plating solution having 40 g/L acid concentration.

When plating is performed in more conductive baths, such as a bath with 40 g/L sulfuric acid concentration, generally higher levels of current should be applied to the second cathode in order to compensate for the terminal effect. Referring to FIG. 5, thickness profiles for deposition of 200 Å of copper on a 300 Å copper seed with sulfuric acid concentration of 40 g/L are presented. Curves 501 and 503 show edge-thick profiles, resulting from no current and 5% of wafer current applied to the second cathode, respectively. Curve 505 corresponds to an essentially uniform layer, obtained when 10% of wafer current is applied to the second cathode. Curve 507 corresponds to a somewhat edge-thin layer, obtained by applying 15% of the wafer current to the second cathode.

Although various details have been omitted for clarity's sake, various design alternatives may be implemented. Therefore, the present examples are to be considered as illustrative and not restrictive, and the invention is not to be limited to the details given herein, but may be modified within the scope of the appended claims.

All documents cited herein are hereby incorporated by reference in their entirety and for all purposes.

What is claimed is:

1. An apparatus for electroplating metal on to a semiconductor wafer having a layer of conductive material, the apparatus comprising:

a vessel configured for holding a plating solution, the vessel having a wall;

an anode disposed within the vessel;

a wafer holder configured for holding a semiconductor wafer in the plating solution within the vessel during electroplating;

a second cathode disposed outside of the vessel within a separate chamber formed on the wall of the vessel, wherein the wall includes a membrane configured for providing ionic communication between the plating solution in the vessel and the second cathode.

2. The apparatus of claim 1, wherein the wall includes openings between the separate chamber and the vessel, and wherein the openings have the membrane provided thereon.

3. The apparatus of claim 2, wherein the openings comprise holes.

4. The apparatus of claim 2, wherein the separate chamber is located at substantially the same vertical elevation as the wafer during electroplating within the vessel.

5. The apparatus of claim 2, wherein the separate chamber is configured to be in fluid communication with the vessel through a weir, whereby the separate chamber is configured to be replenished with the plating solution, at least in part, by overflow from the vessel.

6. The apparatus of claim 1, wherein the separate chamber provides an annularly shaped region on the outside of the vessel.

7. The apparatus of claim 1, wherein the vessel comprises one or more insulating inserts configured to shape electric field lines during electroplating between the semiconductor wafer and the second cathode defining a virtual second cathode.

8. The apparatus of claim 7, wherein the inserts comprise one or more rings about the periphery of the semiconductor wafer and located between the anode and the wafer.

9. The apparatus of claim 7, comprising one or more inserts selected from a group consisting of wedges, bars, ellipses and rings with patterned inside diameter.

10. The apparatus of claim 1, further comprising an anode chamber within the vessel.

11. The apparatus of claim 1, wherein the anode is segmented.

12. The apparatus of claim 1, further comprising one or more virtual anodes.

13. The apparatus of claim 1, further comprising a reference electrode configured with respect to the semiconductor wafer to permit potentiostatic control of the electroplating process.

14. The apparatus of claim 1, further comprising one or more power supplies configured to deliver a first level of current to the semiconductor wafer and a second level of current to the second cathode, wherein the power supplies are connected to the anode.

15. The apparatus of claim 1, further comprising a controller configured to provide potentiostatic control of current flow during immersion of the wafer into the plating solution and galvanostatic control of the current flow after immersion.

16. The apparatus of claim 1, further comprising a controller configured to dynamically control the amount of current flow to the second cathode during electroplating to account for a gradual reduction of the non-uniform current distribution.

17. The apparatus of claim 1, further comprising a controller configured to automatically strip the second cathode of a layer of metal deposited during electroplating.

18. The apparatus of claim 17, wherein the controller is further configured to automatically determine when stripping should be initiated, based on the amount of metal plated to the second cathode.

19. The apparatus of claim 1, wherein the second cathode is composed of material which is inert under electroplating and stripping conditions.

20. A method of electroplating a layer of metal on to a semiconductor wafer having a layer of conductive material in a plating apparatus, the method comprising:

immersing the semiconductor wafer in a plating solution of a main plating vessel;

depositing the layer of metal onto the semiconductor wafer by applying a first level of current to the semiconductor wafer and a second level of current to a second cathode disposed outside the main plating vessel within a separate chamber formed on a wall of the main plating vessel, wherein the wall includes a membrane configured to allow ionic communication between the plating solution and the second cathode, whereby at least a portion of the current flow with respect to the anode is diverted to the second cathode outside the main plating vessel during electroplating.

* * * * *